US010910768B2

(12) United States Patent
Held et al.

(10) Patent No.: US 10,910,768 B2
(45) Date of Patent: Feb. 2, 2021

(54) MOVEABLE FLOATING CONNECTOR

(71) Applicant: Facebook, Inc., Menlo Park, CA (US)

(72) Inventors: Joshua Held, Los Gatos, CA (US); Michael Haken, East Palo Alto, CA (US); Tiffany Jin, San Mateo, CA (US)

(73) Assignee: Facebook, Inc., Menlo Park, CA (US)

( * ) Notice: Subject to any disclaimer, the term of this patent is extended or adjusted under 35 U.S.C. 154(b) by 0 days.

(21) Appl. No.: 16/798,017

(22) Filed: Feb. 21, 2020

(65) Prior Publication Data

US 2020/0266582 A1 Aug. 20, 2020

Related U.S. Application Data

(63) Continuation of application No. 16/200,399, filed on Nov. 26, 2018, now Pat. No. 10,622,761.

(60) Provisional application No. 62/724,961, filed on Aug. 30, 2018.

(51) Int. Cl.

| | |
|---|---|
| ***H01R 13/631*** | (2006.01) |
| ***H01R 12/91*** | (2011.01) |
| ***H01R 12/71*** | (2011.01) |

(52) U.S. Cl.

CPC ..... *H01R 13/6315* (2013.01); *H01R 12/716* (2013.01); *H01R 12/91* (2013.01)

(58) Field of Classification Search

CPC .. H01R 13/6315; H01R 13/28; H01R 12/716; H01R 12/91

USPC ..... 439/247

See application file for complete search history.

(56) References Cited

U.S. PATENT DOCUMENTS

| | | | | |
|---|---|---|---|---|
| 5,317,480 | A | 5/1994 | Chandraiah | |
| 5,793,614 | A | 8/1998 | Tollbom | |
| 6,147,872 | A | 11/2000 | Roy | |
| 6,381,146 | B1 | 4/2002 | Sevier | |
| 6,422,885 | B2 | 7/2002 | Kain | |
| 6,592,387 | B2 | 7/2003 | Komenda | |
| 6,884,096 | B2 | 4/2005 | Centola | |
| 7,121,857 | B1 | 10/2006 | Lewis | |
| 7,485,003 | B2 * | 2/2009 | Mandrusov | H01R 13/6315 439/247 |
| 7,628,629 | B2 | 12/2009 | Miyazaki | |
| 7,950,942 | B2 * | 5/2011 | Klinger | H01R 13/6215 439/247 |
| 8,740,633 | B2 * | 6/2014 | Liao | H01R 13/4532 439/137 |
| 9,614,325 | B2 * | 4/2017 | Yuan | H01R 13/665 |
| 10,239,466 | B2 * | 3/2019 | Campbell | B64D 43/00 |

* cited by examiner

*Primary Examiner* — Hien D Vu

(74) *Attorney, Agent, or Firm* — Van Pelt, Yi & James LLP

(57) ABSTRACT

A movable floating connector is disclosed. In an embodiment, an apparatus includes a fixed structure coupled to a chassis, a movable floating connector assembly, and an elastic object. The movable floating connector assembly includes a receiving connector configured to engage with a module connector of an insertable module removable from the chassis. The elastic object is interfaced between at least a portion of the fixed structure and at least a portion of the movable floating connector assembly. The elastic object is configured to provide a force on the movable floating connector assembly against a direction of insertion of the insertable module to maintain a consistent engagement between the receiving connector of the movable floating connector assembly and the module connector of the insertable module across a variation in length in the direction of insertion.

20 Claims, 9 Drawing Sheets

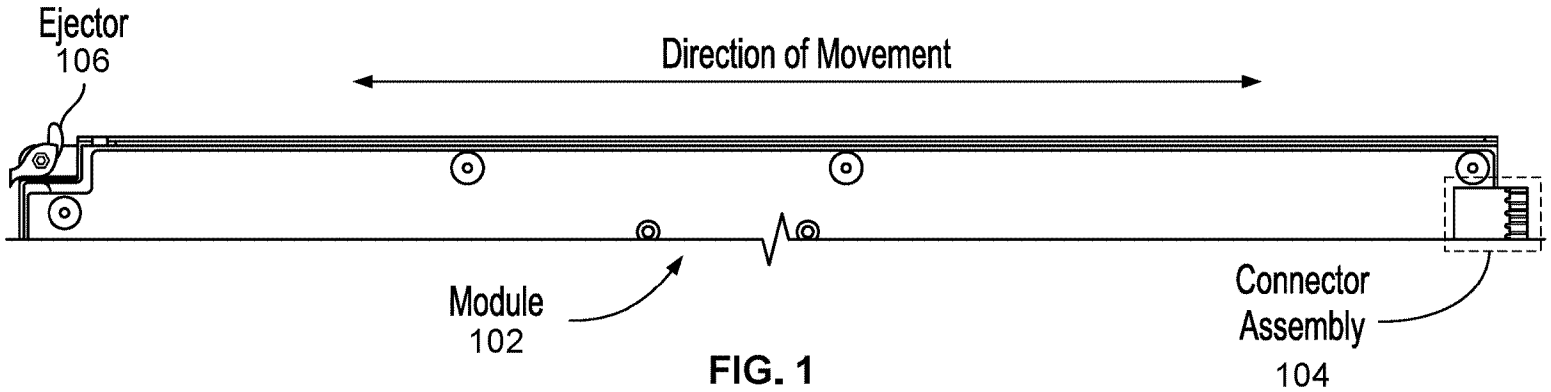
FIG. 1
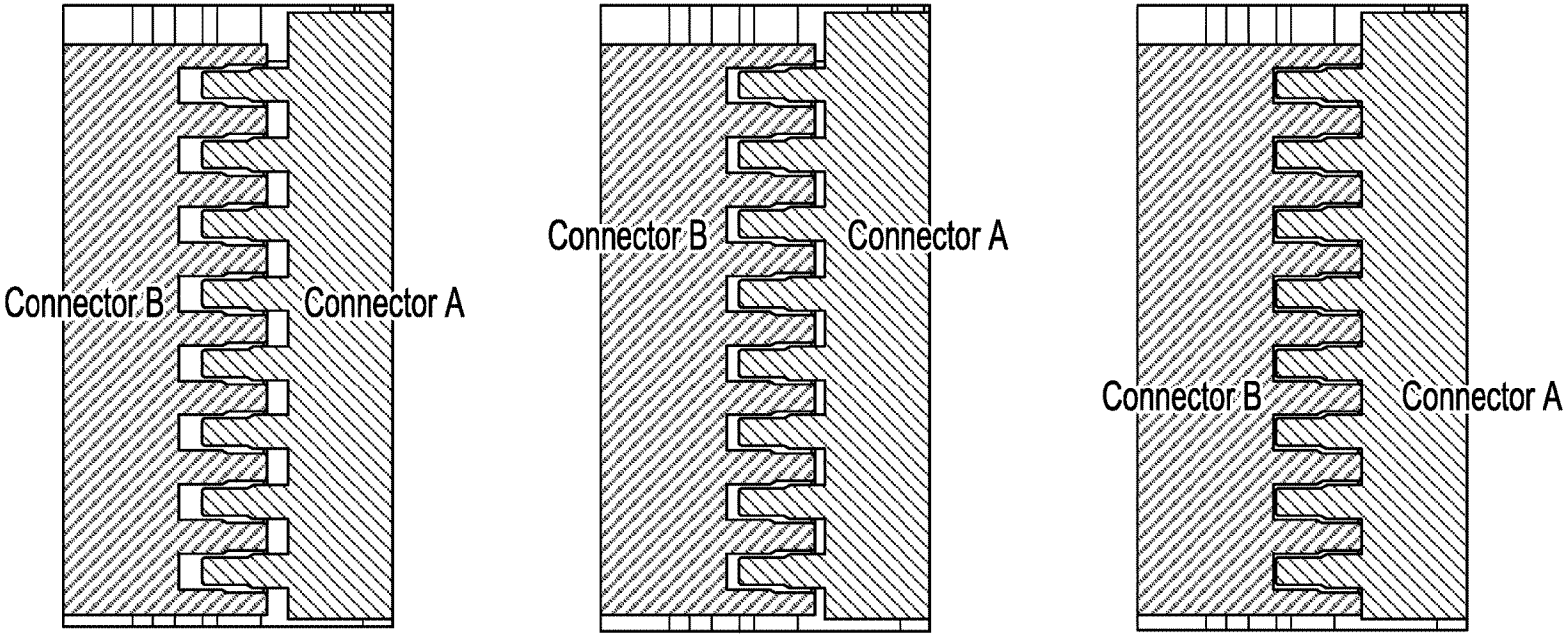
FIG. 2A
FIG. 2B
FIG. 2C

MOVEABLE FLOATING CONNECTOR

CROSS REFERENCE TO OTHER APPLICATIONS

This application is a continuation of U.S. patent application Ser. No. 16/200,399, now U.S. Pat. No. 10,622,761, entitled MOVEABLE FLOATING CONNECTOR filed Nov. 26, 2018, which claims priority to U.S. Provisional Patent Application No. 62/724,961 entitled SPRING LOADED FLOATING CONNECTOR filed Aug. 30, 2018, both of which are incorporated herein by reference for all purposes.

BACKGROUND OF THE INVENTION

Computer equipment is typically made up of removable modules, which allows features such as processing capacity and memory to be expanded or reduced to meet computational needs. Electronic modules are housed in a chassis, and are connected with other modules using connectors. Connectors or contacts can be damaged or fail to engage fully, for example, when the equipment is frequently connected or disconnected such as in a data center or if the equipment is used in environments with vibration or movement.

BRIEF DESCRIPTION OF THE DRAWINGS

Various embodiments of the invention are disclosed in the following detailed description and the accompanying drawings.

FIG. 1 is a diagram showing an example of a module and chassis.

FIG. 2A shows a state of engagement when the length of the removable module is short by a maximum negative tolerance.

FIG. 2B shows a state of engagement when the length of the removable module is at its expected length.

FIG. 2C shows a state of engagement when the length of the removable module is long by a maximum positive tolerance.

DETAILED DESCRIPTION

Figures 3, 4:
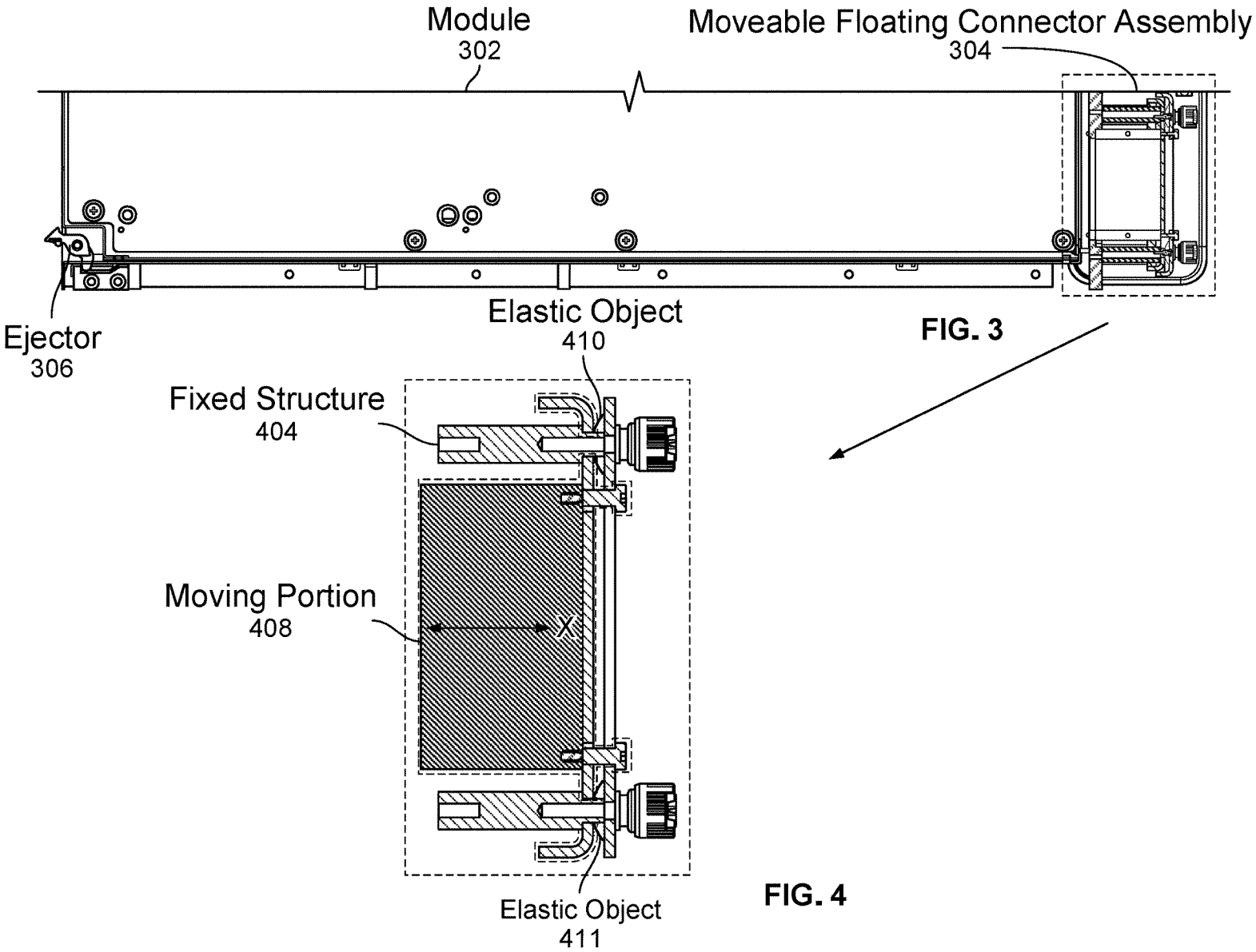
FIG. 3 is a diagram illustrating an embodiment of a module and a chassis in which a moveable floating connector assembly is provided.
FIG. 4 is a diagram illustrating an embodiment of a fixed structure and a movable floating connector assembly.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications, and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

In settings such as data centers, electronic modules (in server racks for example) may be frequently moved or removed (e.g., pushed in and pulled out) for maintenance and testing. Each time a connector on the removable module is pushed in to connect with a corresponding receiving connector fixed within the chassis, it is desirable to ensure that the connector on the removable module is fully engaged with the receiving connector. However, due to variations in dimensions of the removable module, the connector on the removable module may not fully engage with the receiving connector. Additionally, strain applied on the receiving connector due to insertion force may cause the connectors to experience wear and tear that tends to reduce the lifetime of the connectors. FIGS. 1-2C show an example of a typical removable module and engagement between connectors of the module.

FIG. 1 is a diagram showing an example of a module and chassis. In this example, the module has been fitted (inserted/slid) into the chassis. The module 102 has a connector assembly 104 adapted to connect the module to other electronic equipment such as another module. The module can be inserted and/or removed with the aid of ejector 106. For example, the module can be inserted by pushing the module into the chassis. At a certain depth, the module locks into place. The module can be removed by pressing ejector 106. The direction of movement is indicated by the arrow with insertion being in one direction and removal in the opposite direction. Here, the module is inserted from the left direction and is ejected to the left direction.

The module can be sized with an ejector-to-connector tolerance. In a conventional module and chassis assembly, some allowance/space corresponding to the tolerance is provided around the module so that the module has lateral movement tolerance within the chassis. However, conventional module and chassis assemblies do not accommodate movement of the receiving connector in the direction of insertion. Although limiting movement in the direction of insertion allows a force to be applied against the fixed receiving connector by the module connector on the removable module, variations in length of the removable module may cause the module connector on the removable module to not fully engage with the receiving connector. Additionally, strain applied on assembly 104 due to insertion force against the fixed receiving connector may cause the connectors to experience wear and tear that leads to premature failure.

FIGS. 2A-2C are diagrams showing a range of engagements between connectors within tolerances. The shown connectors are examples of connector assembly 104 of FIG. 1. The connections typically have usable wipe length specifications that are to be met to ensure reliable performance of the connections. A wipe length requirement may be specified by a manufacturer, e.g., as the portion (length) of the mating contacts that touches (wipes) from the point of engagement to the point of being fully mated. If the tolerances of the module and chassis are too large, then the connector/contacts can be damaged or fail to connect entirely. Connector B is the connector on the removable module and Connector A is the receiving connector. FIG. 2B shows a state of engagement when the length of the removable module is at its expected length. FIG. 2A shows a state of engagement when the length of the removable module is short by a maximum negative tolerance. If the removable module was any shorter, the connectors would not be properly engaged and result in a connection being not established. FIG. 2C shows a state of engagement when the length of the removable module is long by a maximum positive tolerance. If a removable module was any longer, force applied on connectors to move Connector A beyond the physical limit may cause either of the connectors to break.

A moveable floating connector (and accompanying assembly) is disclosed. In one aspect, the moveable floating connector reduces the likelihood that connectors/contacts become damaged or fail because it helps to maintain a consistent and proper full engagement between connectors. In another aspect, the moveable floating connector makes it easier to comply with wipe length requirements.

In various embodiments, an apparatus includes a fixed (guide) structure coupled to a chassis, a movable floating connector assembly, and an elastic object interfaced between at least a portion of the fixed structure and at least a portion of the moveable floating connector assembly. The moveable floating connector assembly includes a receiving connector configured to engage with a module connector. The module connector is associated with an insertable module removable from the chassis. The elastic object (e.g., a spring, coil, washer, etc.) is configured to provide a force on the movable floating connector assembly against a direction of insertion of the insertable module to maintain a consistent engagement between the receiving connector of the moveable floating connector assembly and the module connector of the insertable module across a variation in length in the direction of insertion. In contrast to the connectors shown in FIGS. 2A-2C, in a moveable connector system, the spring force helps to fully maintain connector engagement regardless of variations in module length. The moveable floating connector assembly tolerates a greater range of movement/locations compared with the system described in the previous figures.

The following figure shows an example of a module and chassis with a moveable floating connector assembly. Sometimes the moveable floating connector assembly is referred to here as a "spring loaded" connector system. However, any elastic object such as a disk or washer can replace the spring to provide the force to maintain connection between the connectors.

FIG. 3 is a diagram illustrating an embodiment of a module and a chassis in which a moveable floating connector assembly is provided. The components shown here are like their counterparts in FIG. 1. Module 302 is shown inserted and its module connector is connected to a receiving connector housed within a device chassis. The module can be any type of computing component module such as a data processing module, data storage module, video processing module, fabric module, switch module, etc. The module has a moveable floating connector assembly 304 adapted to connect the module to other electronic equipment such as another module. Unlike the system in FIG. 1, the moveable floating connector assembly enables connector engagement to be fully maintained regardless of variation in length in the direction of insertion. The ejection mechanism of the ejector 306 is shown in greater detail in FIGS. 10A-10C.

The moveable floating connector assembly 304 can be fitted into a fixed (guide) structure. The following figure shows a fixed (guide) structure coupled to a chassis and a movable floating connector assembly.

FIG. 4 is a diagram illustrating an embodiment of a fixed structure and a movable floating connector assembly. This is a close-up view of moveable floating connector assembly 304. The dashed moving portion 408 moves relative to the fixed structure portion 404. The moving portion 408 includes/accommodates a connector, and is adapted to move along the X-axis shown. Portion 408 is enabled to move at least in part by elastic object 410 and 411 interfaced between the fixed structure 404 and the moving portion 408. In this example, a pair of elastic objects 410 and 411 (shown in FIG. 4 as conical washers) are provided directly behind captive screws of the fixed structure.

Elastic object 410 is adapted to interface between at least a portion of the fixed structure 404 and at least a portion of the moveable floating connector assembly 408. The elastic object (e.g., a disk, spring, washer, or the like) is configured to provide a force on the movable floating connector assembly against a direction of insertion of the insertable module as the elastic object is compressed to maintain a consistent engagement between the receiving connector of the moveable floating connector assembly and the module connector of the insertable module across a variation in length in the direction of insertion. The direction of insertion and the direction of force applied by the elastic object are along the shown x-axis. The variation in length of the removable module (in moving portion 408, e.g., 302) and resulting engagement location of the module connector in the direction of insertion may correspond to a variable location, applied force, and/or variable elastic object compression of the receiving connector and the module connector. The elastic object and the moveable floating connector assembly can be structured for a desired tolerance or distance/range of motion. Various different types of elastic objects are utilized in various different embodiments such that the utilized type of elastic object is matched to a desired length tolerance or spring/compression force. For example, a coil spring may allow for movement over a larger distance compared with a conical washer, as further described with respect to FIG. 9A. Elastic objects 410 and 411 can be implemented by any compressible component that provides an opposing force when compressed. The elastic object can be made of a variety of materials including metal, plastic, rubber, elastomer, silicone, and/or a composite. Examples of the elastic object include a conical washer or Belleville spring as shown.

The elastic object can have a variety of force profiles (e.g., force vs displacement) including non-linear, exponential, linear, etc. A linear force profile may be attractive to maintain a consistent engagement force against the direction of insertion over a larger tolerance distance. On the other hand, a non-linear force profile (e.g., exponential) may be attractive in certain situations such as when a proportional increase in engagement force against the direction of insertion is desired as the module connector is further inserted. For example, it may be desirable to cushion insertion force in a gradually increasing manner as the module is inserted further. The following figures show the fixed structure, moveable floating connector assembly, and elastic object in greater detail.

Figure 5:
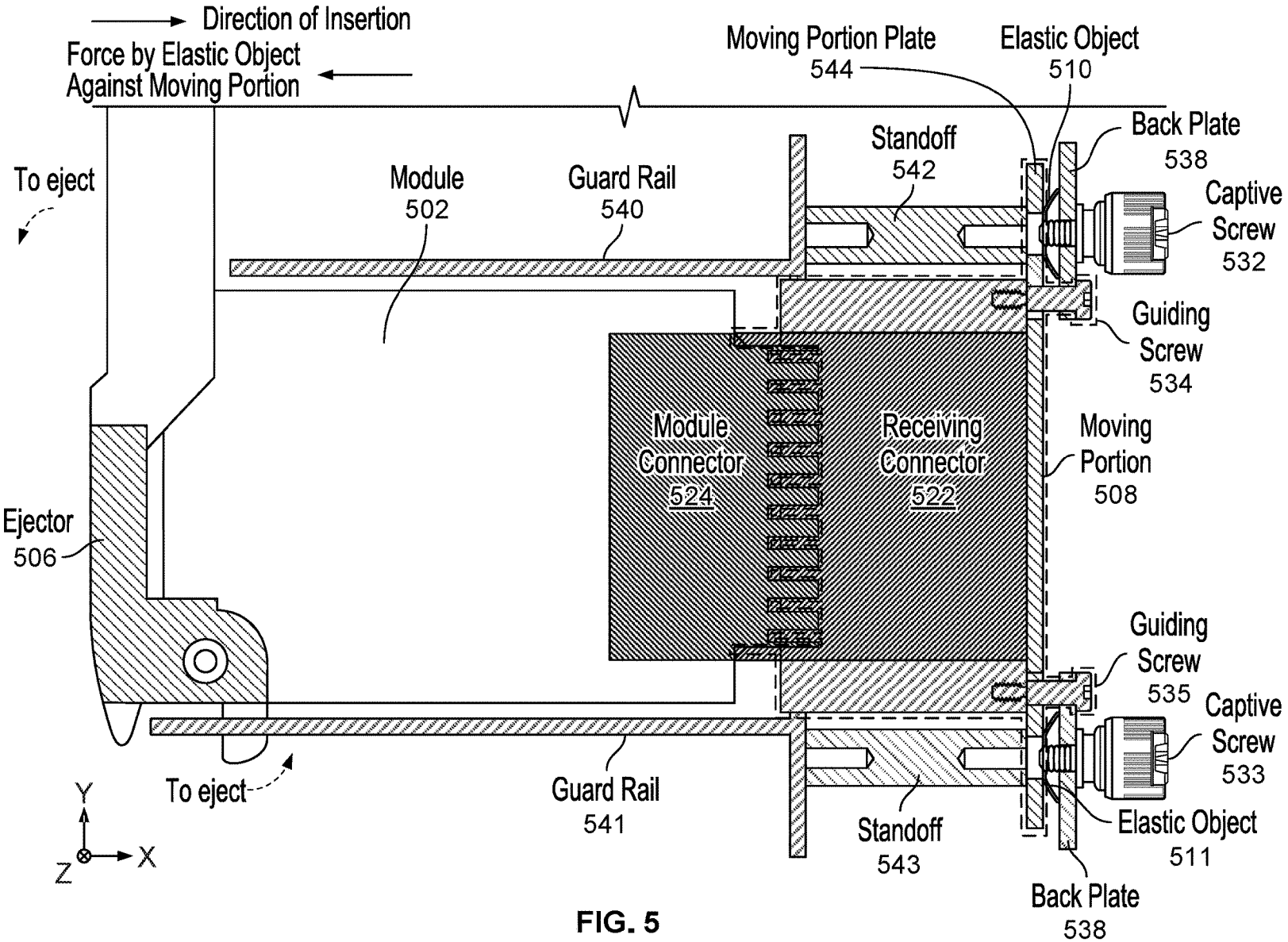
FIG. 5 is a diagram illustrating an embodiment of a movable floating connector assembly.

FIG. 5 is a diagram illustrating an embodiment of a movable floating connector assembly. In this example, the moveable floating connector assembly corresponding to moving portion 508 is depicted as fitted into a fixed (guide) structure corresponding to 404 of FIG. 4.

The fixed (guide) structure includes guard rail 540, guard rail 541, captive screw 532, captive screw 533, standoff 542, standoff 543, and/or back plate 538. The fixed (guide) structure is coupled and fixed to a device chassis, and the moving portion 508 can be inserted into or removed from the chassis. Guard rails 540 and 541 define a region in which the module is insertable. The guard rails define an area in which the insertable module can be placed within the chassis. Captive screws 532 and 533 are configured to be screwed into the fixed structure. The shafts of captive screws 532 and 533 pass through corresponding openings in back plate 538, moving portion plate 544, and the corresponding elastic object to couple them together against the heads of the captive screws contacting the back plate. This is shown in greater detail in FIG. 7. In FIG. 5, a pair of captive screws can be screwed into corresponding standoffs 542 and 543 to form a region occupied by the moving portion 508.

Lengths of the shafts of the captive screws define a distance between the back plate 538 and the moving portion plate 544 for the elastic object 510. The distance defines a range of movement of the moving portion (e.g., range of distance along the axis of direction of module insertion) corresponding to the allowed tolerance (e.g., of length of the insertable module), as further shown in FIGS. 6A-6C. The cover plate 538 is a back plate that forms a movement constrained surface against which the elastic objects 510 and 511 are compressed and exert an opposing force to the moving portion plate against the direction of insertion of module 502. Thus, the cover plate 538 and the moving portion plate 544 provide surfaces against which the elastic objects are contained and compressed, permitting the elastic objects to apply a spring/expansion force. In various embodiments, the captive screw allows the fixed structure to be adjusted, assembled, and disassembled (e.g., to remove/replace the moving portion and/or elastic objects). In some embodiments, the cover plate 538 is rigid and adapted to contain components.

The moving portion 508 includes the receiving connector 522, guiding screw 534, guiding screw 535, and moving portion plate 544. The receiving connector 522 includes a connector adapted for the module connector 524. Receiving connector 522 also connects to another component of the device chassis housing module 502 via a cable (e.g., receiving connector 522 is connected to a motherboard via a flexible ribbon cable). The cable connecting receiving connector 522 to the other chassis component is flexible to allow movement of the moving portion. The receiving connector 522 is configured to engage with a module connector 524. In this example, the connectors engage via respective contacts. The receiving connector is associated with the movable floating connector assembly and can maintain consistent (e.g., full) engagement with the module connector across large variations in module length, given that the elastic materials allow the receiving connector to be moved and forced towards the module connector of the module when the elastic materials are compressed.

The guiding screws are configured to screw into moving portion 508 and be fixed to the moving portion. For example, guiding screws 534 and 535 are fixed to moving portion plate 544 and/or another component of the moving portion. The shafts of guiding screws 534 and 535 pass through corresponding holes in cover plate 538. These holes in the cover plate 538 are narrower than the corresponding heads of guiding screws 534 and 535 that keep the shafts of guiding screws 534 and 535 threaded to cover plate 538. At least portions of the lengths of the shafts of guiding screws 534 and 535 also define a range of movement of the moving portion (e.g., range of distance along the axis of direction of module insertion) corresponding to the allowed tolerance (e.g., of length of the insertable module).

The shafts of the guiding screws 534 and 535 effectively form guide rails for the moving portion that guide and constrain the sliding movement of the moving portion along the axis of the direction of insertion of the insertable module. Additionally, the shafts of captive screws 532 and 533 also effectively form guide rails for the fixed structure that guide and constrain the sliding movement of the moving portion along the axis of the direction of insertion of the insertable module. For example, because the moving portion is constrained to slide along the shafts of guiding screws 534 and 535 (guided by corresponding holes in cover plate 538) and captive screws 532 and 533 (guided by corresponding holes in moving portion plate 544) along the axis of the direction of insertion and removable of module 502, undesired movement of the moving portion along other axes is limited. For example, movement along the x-axis is permitted along the lengths of shafts of guiding screws 534 and 535 and captive screws 532 and 533 but movement in the z-axis and y-axis is constrained by the shafts of the screws contacting the holes of cover plate 538 and/or moving portion plate 544.

The following figures show various compression states. The engagement via the contacts of the connectors is substantially the same across all of the states.

Figure 6A:
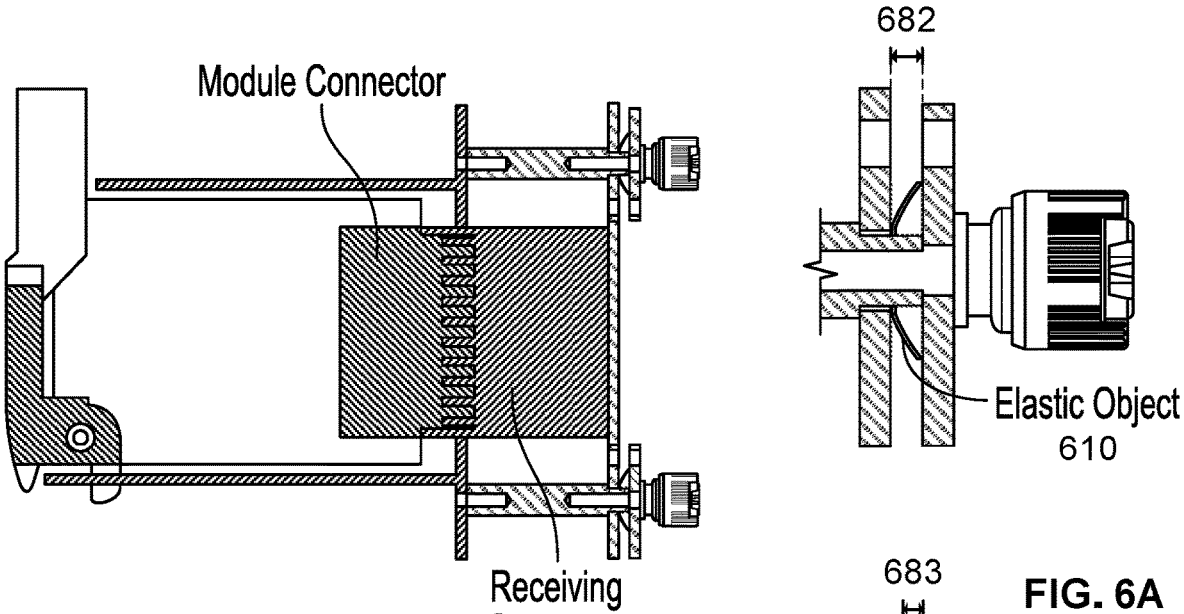
FIG. 6A is a diagram illustrating an embodiment of a movable floating connector assembly pushed by elastic objects in a minimal compression state when engaged by a first insertable/removable module.
Figure 6B:
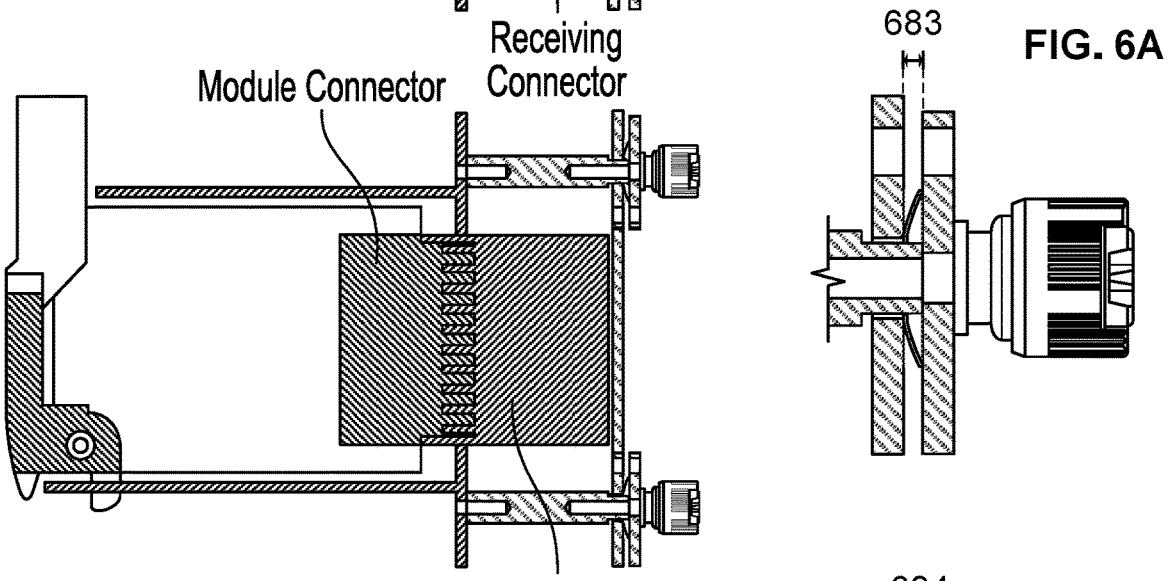
FIG. 6B is a diagram illustrating an embodiment of a movable floating connector assembly pushed by elastic objects in a nominal compression state when engaged by a second insertable/removable module.
Figure 6C:
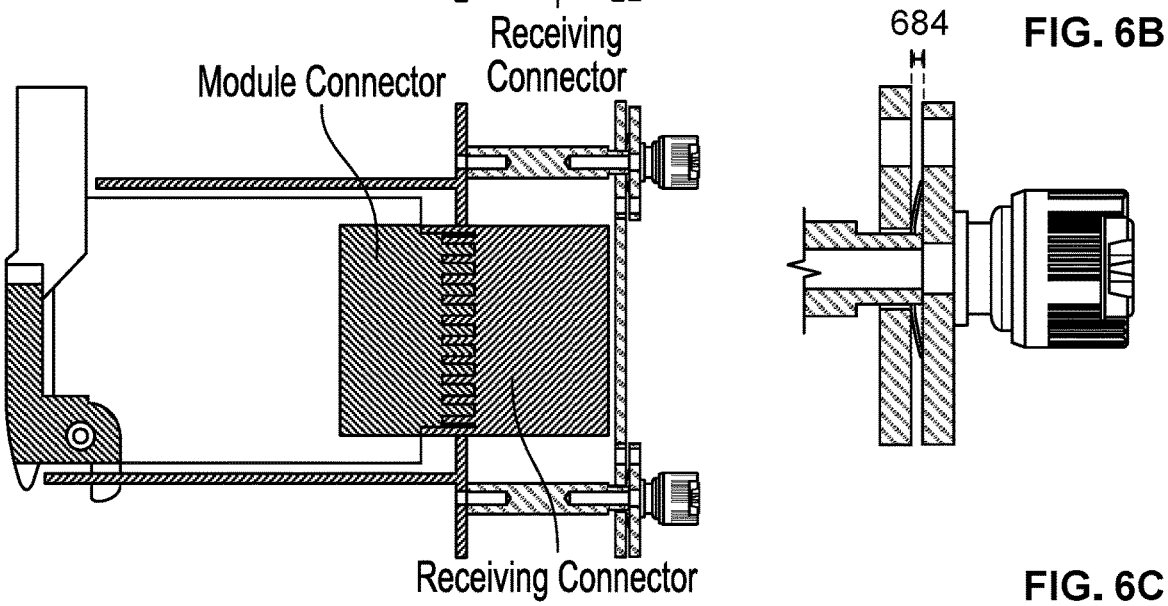
FIG. 6C is a diagram illustrating an embodiment of a movable floating connector assembly pushed by elastic objects in a maximum compression state when engaged by a third insertable/removable module.

Module connector 524 is on module 502. The module can be inserted or removed from the chassis, and contacts of module connector 524 provide an electrical connection interface between components of module 502 and external components interfaced by contacts of receiving connector 522. In some embodiments, ejector 506 is provided to assist in insertion and removal of module connector 524 from receiving connector 522. That is, the ejector is adapted to secure module 502 to guard rails 540 and 541 and also eject module 502 from the chassis. A portion of ejector 506 is configured to be inserted in an opening of guard rail 541 to secure module 502 in place when engaged with receiving connector 522. Pushing the lever in the direction of the dashed arrow causes the module to be ejected from the chassis (to the left side in this example) as leverage is applied against guard rail 541 by ejector 506. An example ejection mechanism is further described with respect to FIGS. 10A-10C. FIGS. 6A-6C show that despite variations in lengths of insertable modules, allowed variations in the compression of the elastic object enable the movable receiving connector to be placed and meet the module connector at a location where it can fully and properly engaged with the connector on the insertable module. The elastic objects are shown at various compression levels in FIGS. 6A-6C that allow a receiving connector to be fully engaged with module connectors across a range of module lengths (e.g., within +/−tolerance allowed by elastic objects).

FIG. 6A is a diagram illustrating an embodiment of a movable floating connector assembly pushed by elastic objects in a minimal compression state when engaged by a first insertable/removable module. Each of the components correspond to the ones in FIG. 5. Some components such as the guiding screws (e.g., shown in FIG. 5) have been omitted for clarity. The connector assembly includes a module connector (e.g., module connector 524) and receiving connector (e.g., receiving connector 522) that engage with each other via respective contactors. Here, there is minimal compression of the elastic objects. Unlike the example in FIG. 2A, the contactors of the connectors are fully engaged as the receiving connector is moved to be pushed against the module connector 524 by the elastic objects. Pictured next to the fixed structure and moveable floating connector assembly is a close-up view of the region surrounding the elastic object. The conical washer elastic object is in a relatively minimal compressed state, as represented by length 682 between the plates.

FIG. 6B is a diagram illustrating an embodiment of a movable floating connector assembly pushed by elastic objects in a nominal compression state when engaged by a second insertable/removable module. Unlike the example in FIG. 2B, the contacts of the connectors are fully engaged as the receiving connector is moved to be pushed against the module connector by the elastic objects. Pictured next to the fixed structure and moveable floating connector assembly is a close-up view of the region surrounding the elastic object 610. The conical washer elastic object is in a moderately compressed state, as represented by length 683 between the plates, which is shorter than length 682.

FIG. 6C is a diagram illustrating an embodiment of a movable floating connector assembly pushed by elastic objects in a maximum compression state when engaged by a third insertable/removable module. Like the examples in FIGS. 6A and 6B, the contacts of the connectors are fully engaged despite the module connector being placed further towards the receiving connector. Pictured next to the fixed structure and moveable floating connector assembly is a close-up view of the region surrounding the elastic object. The conical washer elastic object is in a highly compressed state, as represented by length 684 between the plates, which is shorter than length 683.

Unlike FIGS. 2A-2C, FIGS. 6A-6C show how a moveable floating connector maintains a consistent (e.g., full) engagement between connectors. In one aspect, this advantageously allows movement for full engagement and increases tolerance of variations in module length. This in turn extends the lifetime of the connectors and also improves the reliability of the connectors.

Figure 7:
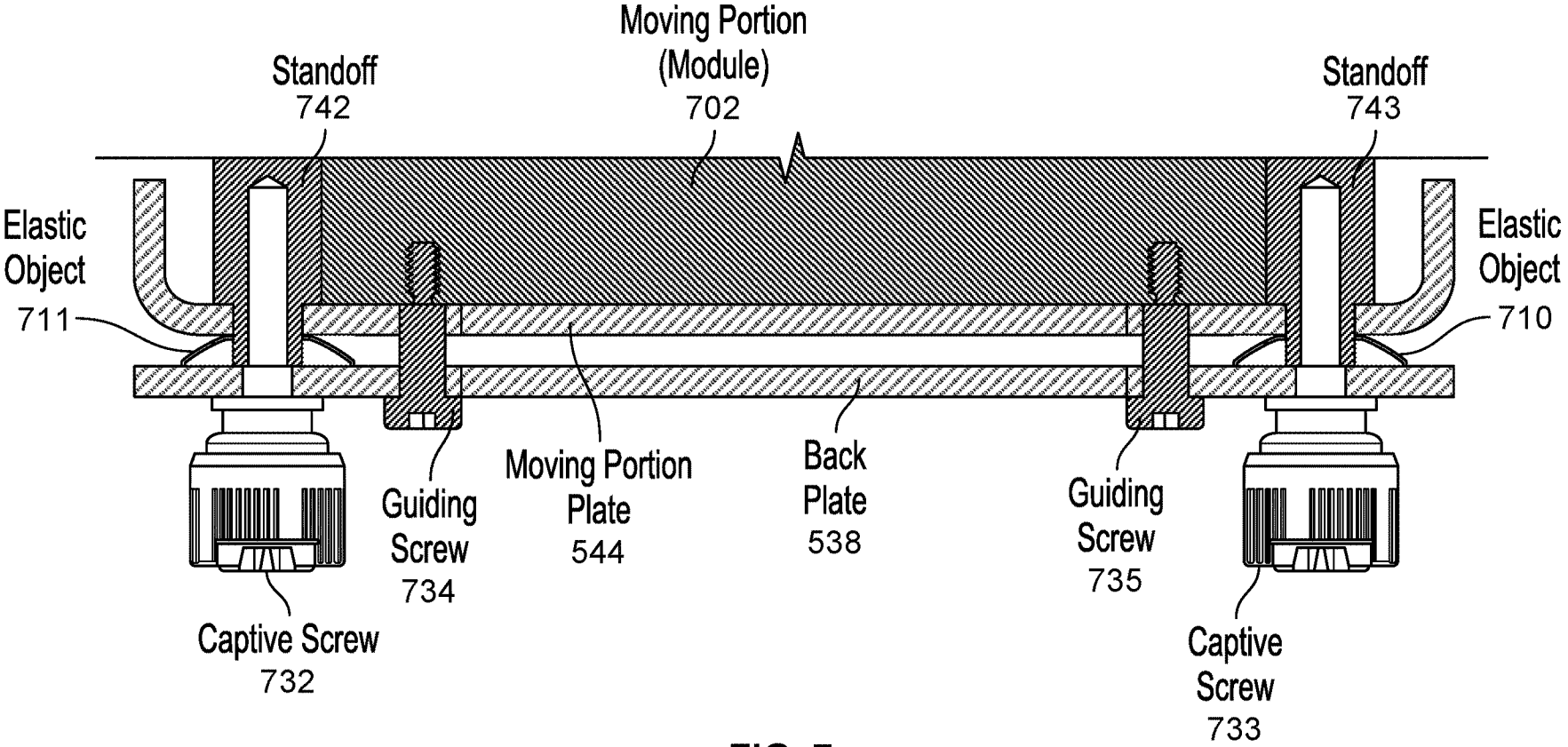
FIG. 7 is a diagram illustrating an embodiment of a movable floating connector assembly.

FIG. 7 is a diagram illustrating an embodiment of a movable floating connector assembly. This is a close-up view of the portion of the connector assembly that engages with guiding screws 734 and 735 of a fixed (guide) structure. In some embodiments, each of the components shown in FIG. 7 corresponds to same named counterparts in FIG. 5. The captive screws 732 and 733 allow the entire moving portion (module) 702 to be quickly removed. For example, both captive screws can be unscrewed from the standoffs 742 and 743 to allow the cover plate, elastic objects (710 and 711), and the entire moving portion to be removed. This allows the moving portion and/or the elastic objects to be easily replaced or upgraded. Additionally, the lengths of the shafts of the captive screws and/or guiding screws can be defined by turning the corresponding screws until desired shaft lengths are achieved. This allows the range of motion of the moving portion to be adjusted as desired.

Figure 8:
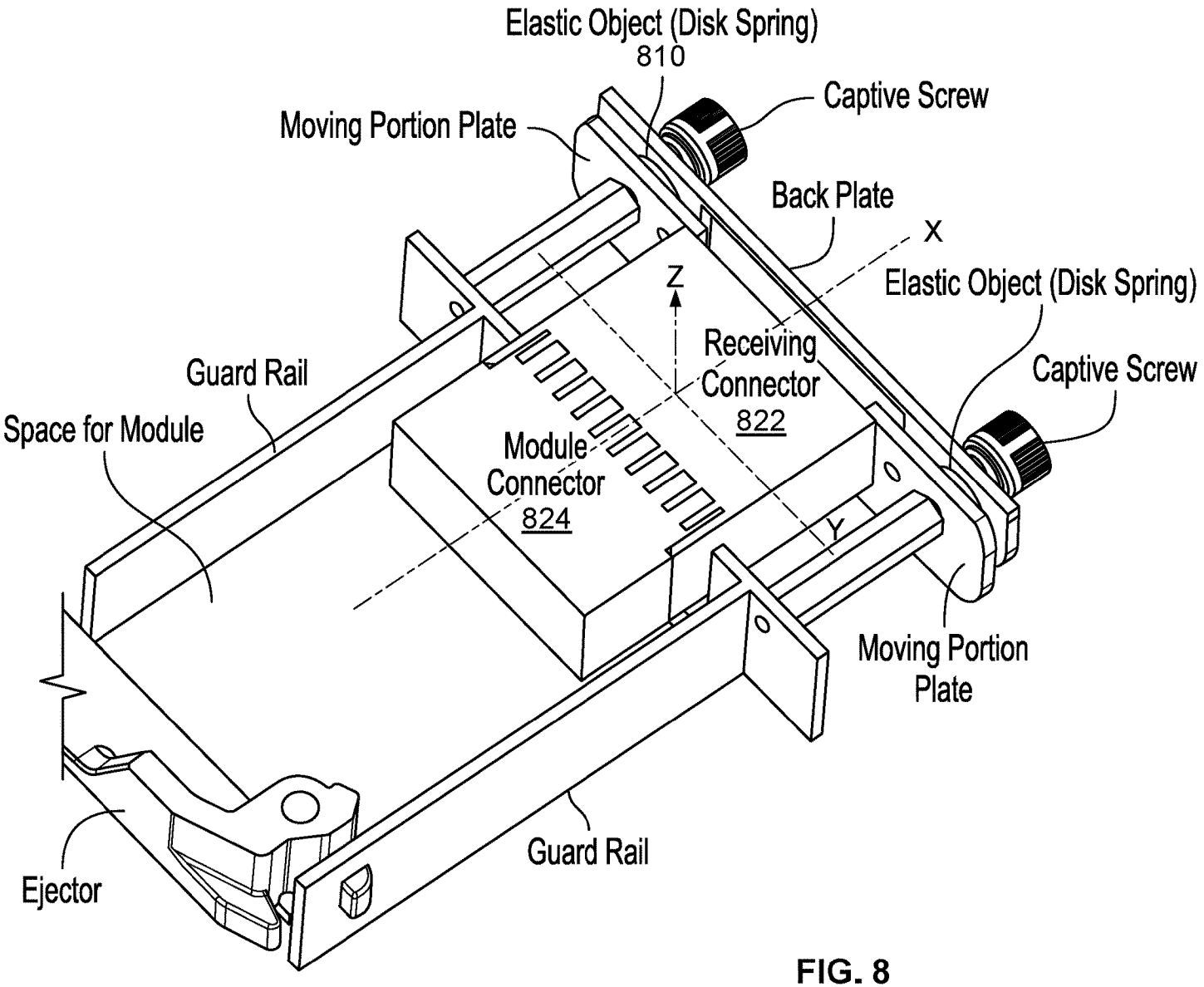
FIG. 8 is a perspective view illustrating an embodiment of a movable floating connector assembly with a disk spring.
Figure 9A:
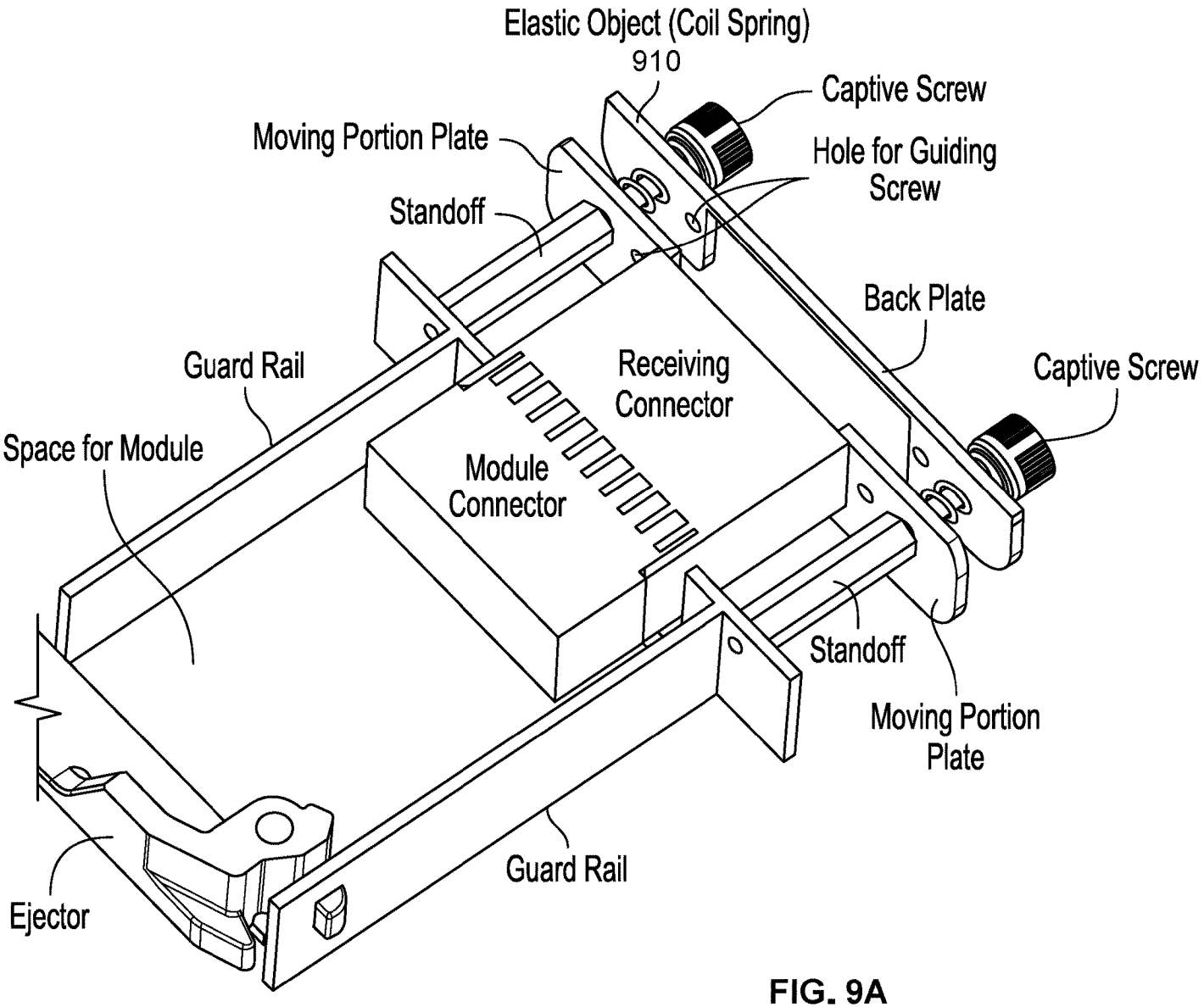
FIG. 9A is a perspective view illustrating an embodiment of a movable floating connector assembly with a coil spring.
Figure 9B:
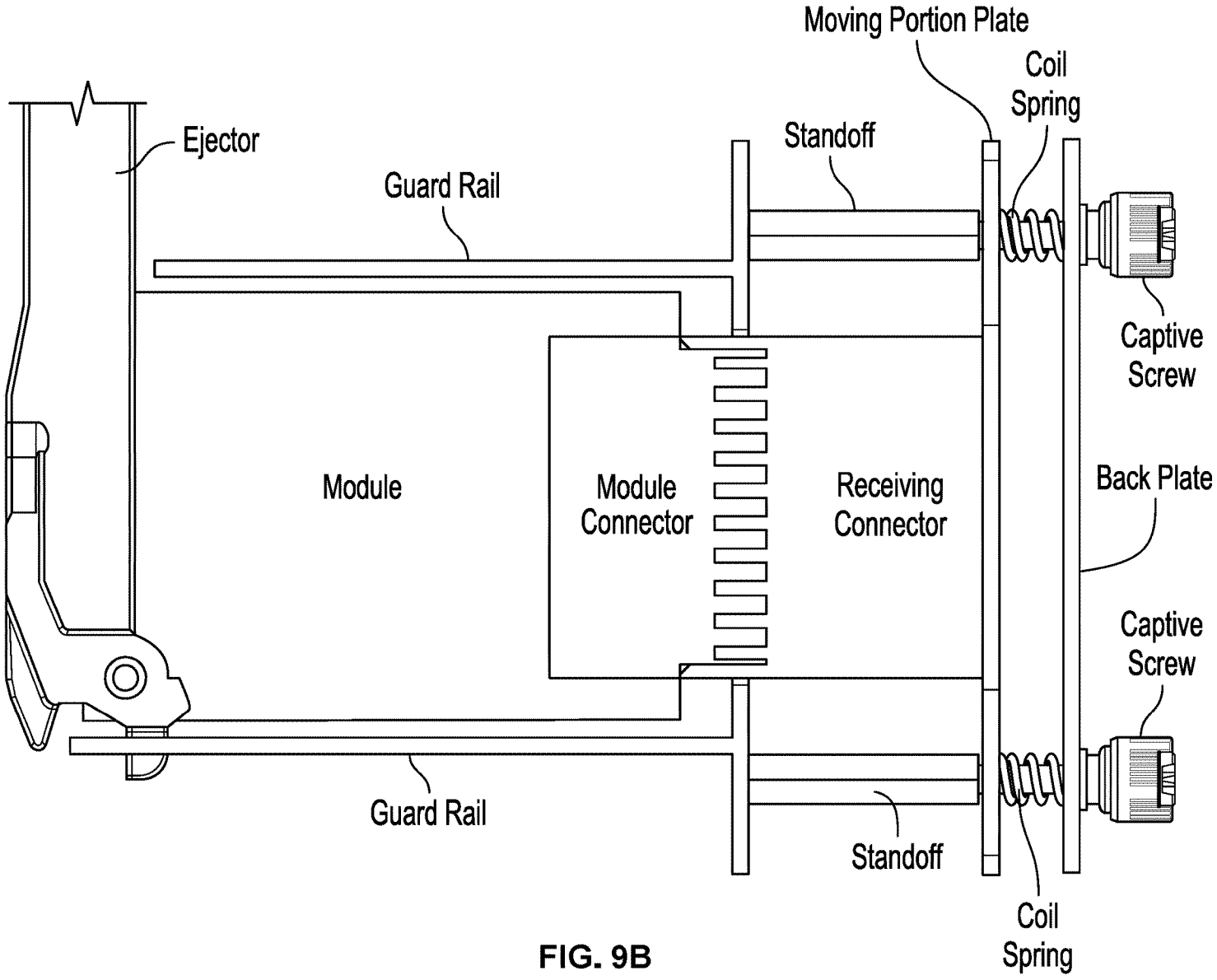
FIG. 9B is a top view illustrating an embodiment of a movable floating connector assembly with a coil spring.

The previous examples depict the elastic object as conical washers. Other types of elastic objects may be used instead. FIG. 8 shows an example of a disk spring, and FIGS. 9A-9B show an example of a coil spring. In FIGS. 8-10C, a portion of the ejector arm is not shown and some components are omitted to better illustrate other components without obscuring the view.

FIG. 8 is a perspective view illustrating an embodiment of a movable floating connector assembly with a disk spring. In some embodiments, each of the components shown in FIG. 8 corresponds to same named counterparts in FIG. 5. Unlike the example in FIG. 5, which uses a conical washer for the elastic object, here the elastic object is a disk spring (810).

This perspective view also shows the degrees of freedom of the moveable floating connector assembly (X, Y, and Z or out of the page). The moveable floating connector assembly facilitates movement in the X direction, which increases a range of tolerance of positions where a module connector is able to be properly engaged with a receiving connector. In various embodiments, slight movements of the receiving connector in the Y and Z directions are enabled to ease positional alignment of the module connector and the receiving connector as they are connected together. For example, contacts of the receiving connector are configured to allow the slight Y and Z directional movements and/or sizing of the holes in the cover plate and/or moving of the portion plate are configured to allow the slight Y and Z directional movements. In this regard, the moveable floating connector facilitates mating of module connector 824 to receiving connector 822 so that they have a greater range of motion/locations compared with the conventional system shown in FIG. 1.

FIG. 9A is a perspective view illustrating an embodiment of a movable floating connector assembly with a coil spring. FIG. 9B is a top view illustrating an embodiment of a movable floating connector assembly with a coil spring. In some embodiments, each of the components shown in FIGS. 9A and 9B corresponds to same named counterparts in FIG. 5. For simplicity, some components such as the standoffs and guiding screws are not shown here. The hold for the guiding screw is a threaded hole that is adapted to receive a screw. The guiding screw can be screwed into the hole and coupled to another component (not shown) on the other side of this hole. Unlike the example in FIG. 5, which uses a conical washer for the elastic object, here, the elastic object is a coil spring. A coil spring 910 may provide more force control over a larger compression distance than some other types of elastic objects.

Figure 10A:
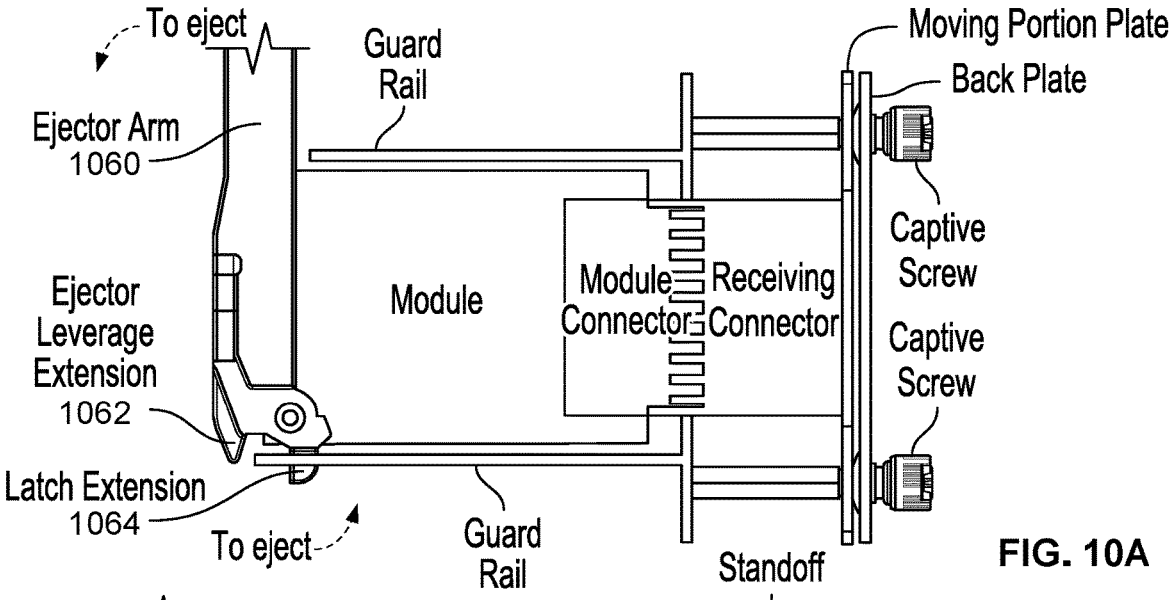
FIG. 10A is a perspective view illustrating an embodiment of a movable floating connector assembly in a latched state.

FIG. 10A is a perspective view illustrating an embodiment of a movable floating connector assembly in a latched state. In some embodiments, each of the shown components shown in FIGS. 10A-10C corresponds to same named counterparts in FIG. 5. For simplicity and to illustrate the embodiment clearly, some components are not shown in FIG. 10A. The moveable floating connector assembly in a latched state where latch extension 1064 of ejector arm 1060 is inserted and fully engaged in an opening of the guard rail is shown. The connectors are fully engaged. To eject the module from the chassis, ejector arm 1060 on the module is pivoted down and to the left in the direction of the dashed arrow pointing left (the corresponding movement of the latch extension 1064 out of the opening of the guard rail is in the direction of the dashed arrow pointing right).

Figure 10B:
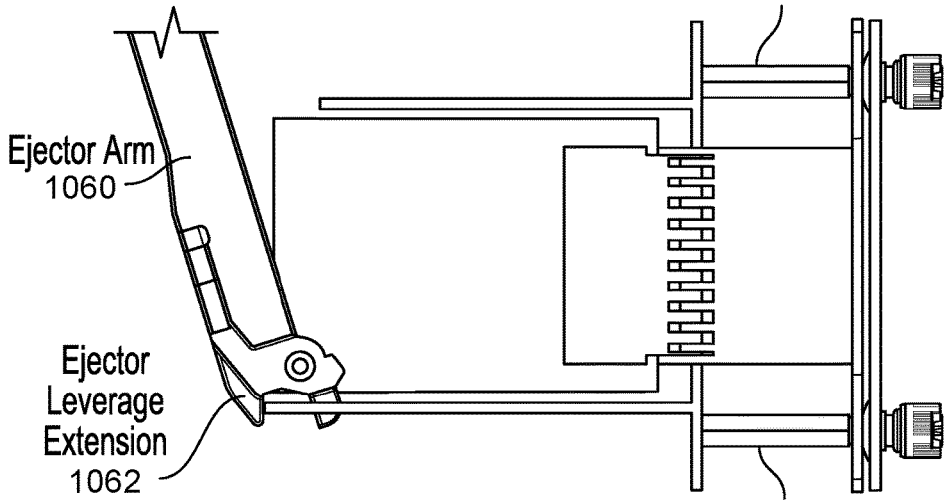
FIG. 10B is a perspective view illustrating an embodiment of a movable floating connector assembly in a semi-ejected state.

FIG. 10B is a perspective view illustrating an embodiment of a movable floating connector assembly in a semi-ejected state. Here, the connectors have begun to disengage from each other as the module is semi-ejected. The arm 1060 of the ejector pivots and rotates away from the chassis, which helpfully allows a technician to hold on to the module being removed from the chassis. As the ejector arm is rotated, ejector leverage extension 1062 pushes against and applies leverage to the guard rail to pull the module out as latch extension 1064 is rotated out of the latch opening of the guard rail.

Figure 10C:
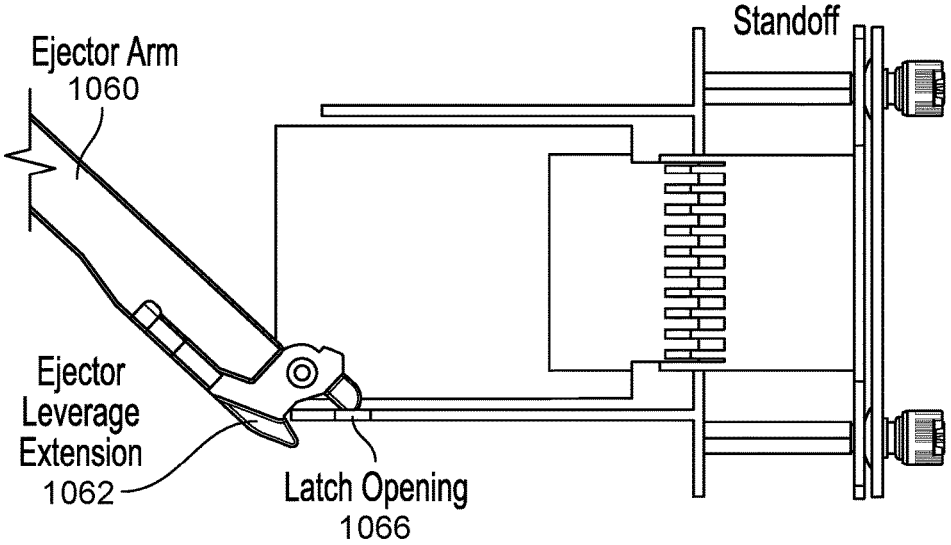
FIG. 10C is a perspective view illustrating an embodiment of a movable floating connector assembly in an ejected state.

FIG. 10C is a perspective view illustrating an embodiment of a movable floating connector assembly in an ejected state. In the ejected state, the module connector is disengaged from the receiving connector of the chassis. The ejector leverage extension 1062 continues to push against guard rail 1066 as ejector arm 1060 is further rotated to provide leverage against the fixed (guide) structure and help eject the module. The module can be easily removed from the chassis at this state, for example, by simply sliding the module to the left right. The guard rails help to guide the module out of the chassis in the ejection process.

In various embodiments, a method of manufacturing a moveable floating connector assembly includes providing a fixed structure coupled to a chassis. The method further comprises providing a movable floating connector assembly, where the moveable floating connector assembly includes a receiving connector and a module connector of an insertable module removable from the chassis. The method further comprises engaging the receiving connector with the module connector. The method further comprises providing an elastic object between at least a portion of the fixed structure and at least a portion of the moveable floating connector assembly, where the elastic object is configured to provide a force on the movable floating connector assembly against a direction of insertion of the insertable module to maintain a consistent engagement between the receiving connector of the moveable floating connector assembly and the module connector of the insertable module across a variation in length in the direction of insertion.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. An electrical apparatus comprising:

a fixed structure including a back plate and at least one guard rail, wherein the at least one guard rail defines a region within a chassis;

a movable portion including a receiving connector configured to engage with a module connector of an insertable module, wherein the insertable module is removable from the chassis; and an elastic object interfaced between at least a portion of the back plate and at least a portion of the movable portion and configured to provide a force on the movable portion against a direction of insertion of the insertable module to maintain a consistent engagement between the receiving connector of the movable portion and the module connector of the insertable module across a variation in length in the direction of insertion, wherein:

the fixed structure further includes a standoff and a captive screw with a shaft configured to fit into the standoff, the standoff positioned on a moving portion plate of the movable portion, and enables a replacement or upgrade of the movable portion, and the captive screw is configured to pass through the back plate and is accessible and removable from a back side of the electrical apparatus opposite a front side providing insertion access to the receiving connector.

2. The electrical apparatus of claim 1, wherein the variation in length in the direction of insertion corresponds to a variation in a length of the insertable module.

3. The electrical apparatus of claim 1, wherein the elastic object is a conical washer made of an elastomer.

4. The electrical apparatus of claim 1, wherein the elastic object is a disk spring.

5. The electrical apparatus of claim 1, wherein the elastic object is a coil spring.

6. The electrical apparatus of claim 1, wherein the at least one guard rail defines a region in which the module is insertable.

7. The electrical apparatus of claim 1, wherein the shaft of the captive screw is threaded through the elastic object.

8. The electrical apparatus of claim 1, wherein the shaft of the captive screw is configured to guide movement of the movable portion.

9. The electrical apparatus of claim 1, wherein the shaft of the captive screw is threaded through an opening on a component of the movable portion.

10. The electrical apparatus of claim 9, wherein the shaft of the captive screw is also threaded through the back plate.

11. The electrical apparatus of claim 1, wherein the captive screw is screwed into a standoff included in the fixed structure.

12. The electrical apparatus of claim 1, further comprising a second elastic object configured to provide a second force on the movable portion against the direction of insertion of the insertable module.

13. The electrical apparatus of claim 1, wherein the movable portion includes a guiding screw configured to guide movement of the movable portion.

14. The electrical apparatus of claim 13, wherein the guiding screw is threaded through an opening of a plate that is coupled to the fixed structure.

15. The electrical apparatus of claim 14, wherein the plate is threaded through the captive screw.

16. The electrical apparatus of claim 13, wherein a shaft of the guiding screw is configured to guide movement of the movable portion.

17. The electrical apparatus of claim 1, wherein the fixed structure includes a latch opening configured to receive a latch extension of a moving arm of the insertable module.

18. The electrical apparatus of claim 1, wherein the insertable module includes an ejector arm configured to pivot and apply leverage against the fixed structure to eject the module connector from the receiving connector.

19. A method of manufacturing an electrical apparatus comprising:

providing a fixed structure including a back plate and at least one guard rail, wherein the at least one guard rail defines a region within a chassis;

providing a movable portion including a receiving connector configured to engage with a module connector of an insertable module, wherein the insertable module is removable from the chassis; and providing an elastic object interfaced between at least a portion of the back plate and at least a portion of the movable portion and configured to provide a force on the movable portion against a direction of insertion of the insertable module to maintain a consistent engagement between the receiving connector of the movable portion and the module connector of the insertable module across a variation in length in the direction of insertion, wherein:

the fixed structure further includes a standoff and a captive screw with a shaft configured to fit into the standoff, the standoff positioned on a moving portion plate of the movable portion, and enables a replacement or upgrade of the movable portion, and the captive screw is configured to pass through the back plate and is accessible and removable from a back side of the movable portion opposite a front side providing insertion access to the receiving connector.

20. The electrical apparatus of claim 9, wherein the elastic object is aligned with the shaft of the captive screw such that the captive screw passes through the elastic object and is threaded through the back plate.

* * * * *